US008596733B2

(12) United States Patent
Akatsuka et al.

(10) Patent No.: US 8,596,733 B2
(45) Date of Patent: Dec. 3, 2013

(54) LIQUID EJECTING APPARATUS WITH TWO LIQUID TANKS, WHEREIN LIQUID IS TRANSFERRED TO A TANK OF WHICH RESIDUAL AMOUNT OF LIQUID IS SMALLER FROM A TANK OF WHICH RESIDUAL AMOUNT OF LIQUID IS LARGER WHEN THE POWER IS TURNED ON

(75) Inventors: Yasushi Akatsuka, Higashichikuma-gun (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/954,583

(22) Filed: Nov. 24, 2010

(65) Prior Publication Data

US 2011/0128314 A1 Jun. 2, 2011

(30) Foreign Application Priority Data

Nov. 27, 2009 (JP) ..... 2009-269936

(51) Int. Cl.
*B41J 29/38* (2006.01)
*B41J 2/175* (2006.01)

(52) U.S. Cl.
USPC ..... 347/6; 347/85

(58) Field of Classification Search
USPC ..... 347/6, 89, 85, 7
See application file for complete search history.

(56) References Cited

U.S. PATENT DOCUMENTS

| | | | | |
|---|---|---|---|---|
| 4,042,937 | A * | 8/1977 | Perry et al. | 347/89 |
| 4,998,120 | A | 3/1991 | Koto et al. | |
| 5,105,209 | A | 4/1992 | Koto et al. | |
| 6,082,851 | A * | 7/2000 | Shihoh et al. | 347/85 |
| 2002/0047882 | A1 * | 4/2002 | Karlinski et al. | 347/85 |
| 2003/0007045 | A1 | 1/2003 | Yoshida et al. | |
| 2003/0007047 | A1 | 1/2003 | Otsuka et al. | |
| 2003/0011668 | A1 | 1/2003 | Yoshida | |
| 2004/0090501 | A1 | 5/2004 | Yoshida et al. | |
| 2008/0158307 | A1 * | 7/2008 | Nitta et al. | 347/85 |
| 2009/0027461 | A1 * | 1/2009 | Asada | 347/85 |
| 2009/0160887 | A1 * | 6/2009 | Hamazaki et al. | 347/7 |

FOREIGN PATENT DOCUMENTS

| | | | |
|---|---|---|---|
| JP | 01-255548 | A | 10/1989 |
| JP | 11-020181 | A | 1/1999 |
| JP | 2002-001992 | A | 1/2002 |
| JP | 2002-370374 | A | 12/2002 |
| JP | 2006-027617 | A | 2/2006 |
| JP | 2008-213281 | A | 9/2008 |
| JP | 2009-113412 | A | 5/2009 |
| WO | WO 2008/108245 | A1 | 9/2008 |

* cited by examiner

*Primary Examiner* — Stephen Meier
*Assistant Examiner* — Carlos A Martinez
(74) *Attorney, Agent, or Firm* — Kilpatrick Townsend & Stockton LLP

(57) ABSTRACT

In a liquid ejecting apparatus, when a ON/OFF detector detects that power of the liquid ejecting apparatus is switched to an ON state from an OFF state, a controller controls a liquid transfer unit such that liquid is transferred to a tank of which residual amount of liquid is smaller from a tank of which residual amount of liquid is larger based on the residual amount of liquid in a first tank detected by the first liquid residual amount detector and the residual amount of liquid in a second tank detected by the second liquid residual amount detector.

15 Claims, 4 Drawing Sheets

LIQUID EJECTING APPARATUS WITH TWO LIQUID TANKS, WHEREIN LIQUID IS TRANSFERRED TO A TANK OF WHICH RESIDUAL AMOUNT OF LIQUID IS SMALLER FROM A TANK OF WHICH RESIDUAL AMOUNT OF LIQUID IS LARGER WHEN THE POWER IS TURNED ON

BACKGROUND

1. Technical Field

The present invention relates to a liquid ejecting apparatus.

2. Related Art

As a liquid ejecting apparatus, an ink jet printer (hereinafter, referred to as printer) which ejects ink (liquid) onto a recording medium from ejection orifices (nozzles) of a recording head (liquid ejecting head) has been known.

The printer includes a tank which accommodates ink. In the printer, ink in the tank is supplied to a recording head and ink is discharged from the recording head. The ink is commonly made of a dispersion containing solid content such as pigment and a dispersion medium such as a solvent.

When such ink is used in the printer, particularly if the printer is made to be in an OFF state and is kept to be in a non-used state for a long period of time, the solid content in the ink accommodated in the tank is separated and settled down (precipitated). This causes non-uniformity of solid content concentration in the ink. Then, if the solid content is settled down and the solid content concentration is made non-uniform as described above, the following disadvantages are caused. When after power is turned OFF, the power is turned ON again and ink is discharged so as to perform printing, the solid content settled down in the tank is supplied to the ink jet head as it is. Therefore, there arise disadvantages that nozzle clogging of the recording head is caused and further unevenness of recording quality is caused.

Then, the following recording apparatus (printer) has been known (for example, see JP-A-2008-213281) in order to prevent such disadvantages. In the recording apparatus, a main tank and a sub tank are prepared as tanks for storing (accommodating) ink. Further, the main tank and the sub tank are connected with one flow path and one of the main tank and the sub tank is set to be at high pressure and the other is set to be at low pressure. Then, ink is made to reciprocate between the tanks so as to prevent solid content from being settled down in both of the main tank and the sub tank.

In the recording apparatus, capacities of the main tank and the sub tank are set to be substantially the same. Further, in order to completely mix ink for preventing solid content from being settled down in each of the main tank and the sub tank and, ink is fed to one of the main tank and the sub tank until ink in the other becomes substantially empty. Then, a liquid feeding direction is changed before the tank becomes completely empty so as to make ink flow all the time.

However, in the above recording apparatus, operations while the power is in the ON state are described but operations while the power is in the OFF state are not described at all. Therefore, operations when the power is switched to the ON state from the OFF state are not considered at all.

For example, it is assumed that the capacities of the main tank and the sub tank are set to 100 ml and power is turned OFF while ink is being fed from the main tank to the sub tank. Further, it is assumed that a residual amount of ink in the main tank is 90 ml and a residual amount of ink in the sub tank is 10 ml when the power is turned OFF. In this case, even if solid contents of inks in both of the tanks have been settled down while the power has been in the OFF state, if ink is flown into the sub tank from the main tank by 10 ml when the power is turned ON, ink in the sub tank is sufficiently stirred.

However, if it is assumed that the residual amount of ink in the main tank is 10 ml and the residual amount of ink in the sub tank is 90 ml, even if ink is flown into the sub tank from the main tank by 10 ml when the power is turned ON, a sufficient stirring effect cannot be obtained in the sub tank.

SUMMARY

An advantage of some aspects of the invention is to provide a liquid ejecting apparatus which prevents disadvantages caused by settling of solid content and is capable of preferable operations even when power is switched between an ON state and an OFF state.

A liquid ejecting apparatus according to an aspect of the invention includes a liquid ejecting head which ejects liquid and a first tank and a second tank which accommodate the liquid. Further, the liquid ejecting apparatus is provided with a first liquid residual amount detector which detects a residual amount of liquid in the first tank, a second liquid residual amount detector which detects a residual amount of liquid in the second tank, a first flow path which makes the first tank and the second tank communicate with each other, a second flow path which makes at least one of the first tank and the second tank communicate with the liquid ejecting head, a liquid transfer unit which is capable of transferring liquid in the first tank into the second tank through the first flow path and transferring liquid in the second tank into the first tank through the first flow path, an ON/OFF detector which detects that power of the liquid ejecting apparatus is turned ON/OFF, and a controller which controls the liquid transfer unit, and when the ON/OFF detector detects that the power of the liquid ejecting apparatus is switched to an ON state from an OFF state, the controller controls the liquid transfer unit such that liquid is transferred to a tank of which residual amount of liquid is smaller from a tank of which residual amount of liquid is larger based on the residual amount of liquid in the first tank detected by the first liquid residual amount detector and the residual amount of liquid in the second tank detected by the second liquid residual amount detector.

According to the liquid ejecting apparatus, when the power of the liquid ejecting apparatus is switched to an ON state from an OFF state, liquid is transferred to a tank of which residual amount of liquid is smaller from a tank of which residual amount of liquid is larger. Therefore, since the tank of which residual amount of liquid is smaller receives liquid supply, liquid flows in the tank. Accordingly, a stirring effect can be obtained because liquid which has remained in the tank also flows together so that solid content which has settled down is uniformly dispersed again. Then, liquid is supplied to the liquid ejecting head from the tank and liquid droplets are discharged from the liquid ejecting head. Therefore, discharge characteristics are made stable and recording quality is made uniform and improved.

Further, in the liquid ejecting apparatus, it is preferable that a power shut-off time detector which detects a power shut-off interval until the liquid ejecting apparatus is powered ON since the liquid ejecting apparatus has been powered OFF be provided, and when the ON/OFF detector detects that the power of the liquid ejecting apparatus is switched to the ON state from the OFF state and the power shut-off time detector detects that the power shut-off interval is equal to or more than a predetermined time, it is preferable that the controller control the liquid transfer unit such that after liquid is transferred to a tank of which residual amount of liquid is smaller from a tank of which residual amount of liquid is larger, a liquid transferring direction between the tanks is made reverse and liquid is transferred again.

If the power shut-off interval is equal to or more than a predetermined interval, settling of the solid content is accelerated in the tank of which residual amount of liquid is larger so that the solid content concentration is made different between an upper portion and a lower portion in the tank in some case. If only liquid in the upper portion (supernatant liquid) is transferred to the tank of which residual amount of liquid is smaller under the state, the solid content concentration in the liquid is decreased in the tank. Then, after liquid is transferred to the tank of which residual amount of liquid is smaller from the tank of which residual amount of liquid is larger, a liquid transferring direction between the tanks is made reverse and liquid is transferred again. With this configuration, settling can be eliminated in both of the tanks while the solid content concentration is made uniform in liquids in both of the tanks.

In the liquid ejecting apparatus, it is preferable that when liquid is transferred to a tank of which residual amount of liquid is smaller from a tank of which residual amount of liquid is larger by the liquid transfer unit, the controller control the liquid transfer unit such that all the amount of liquid in the tank of which residual amount of liquid is larger is not transferred and only a predetermined amount of liquid is transferred, and then, a liquid transferring direction between the tanks is made reverse and liquid is transferred again.

With this configuration, a stirring effect is enhanced particularly when the liquid transferring direction between the tanks is made reverse and liquid is transferred again in comparison with a case where all the amount of liquid in the tank of which residual amount of liquid is larger is transferred.

In the liquid ejecting apparatus, it is preferable that the second flow path be configured such that both of the first tank and the second tank are communicated with the liquid ejecting head and that a switching valve which makes any one of the first tank and the second tank communicate with the liquid ejecting head and shuts out the other of the first tank and the second tank be provided on the second flow path.

With this configuration, the tank in which settling has been eliminated is selected by the switching valve so that liquid in the selected tank can be supplied to the liquid ejecting head.

In the liquid ejecting apparatus, it is preferable that after the liquid transferring between the tanks by the liquid transfer unit is ended, the controller control the switching valve such that a tank of which residual amount of liquid is larger is communicated with the liquid ejecting head.

With this configuration, liquid can be preferentially supplied to the liquid ejecting head from the tank of which residual amount of liquid is larger. Accordingly, liquid droplets can be discharged from the liquid ejecting head stably for a long period of time.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
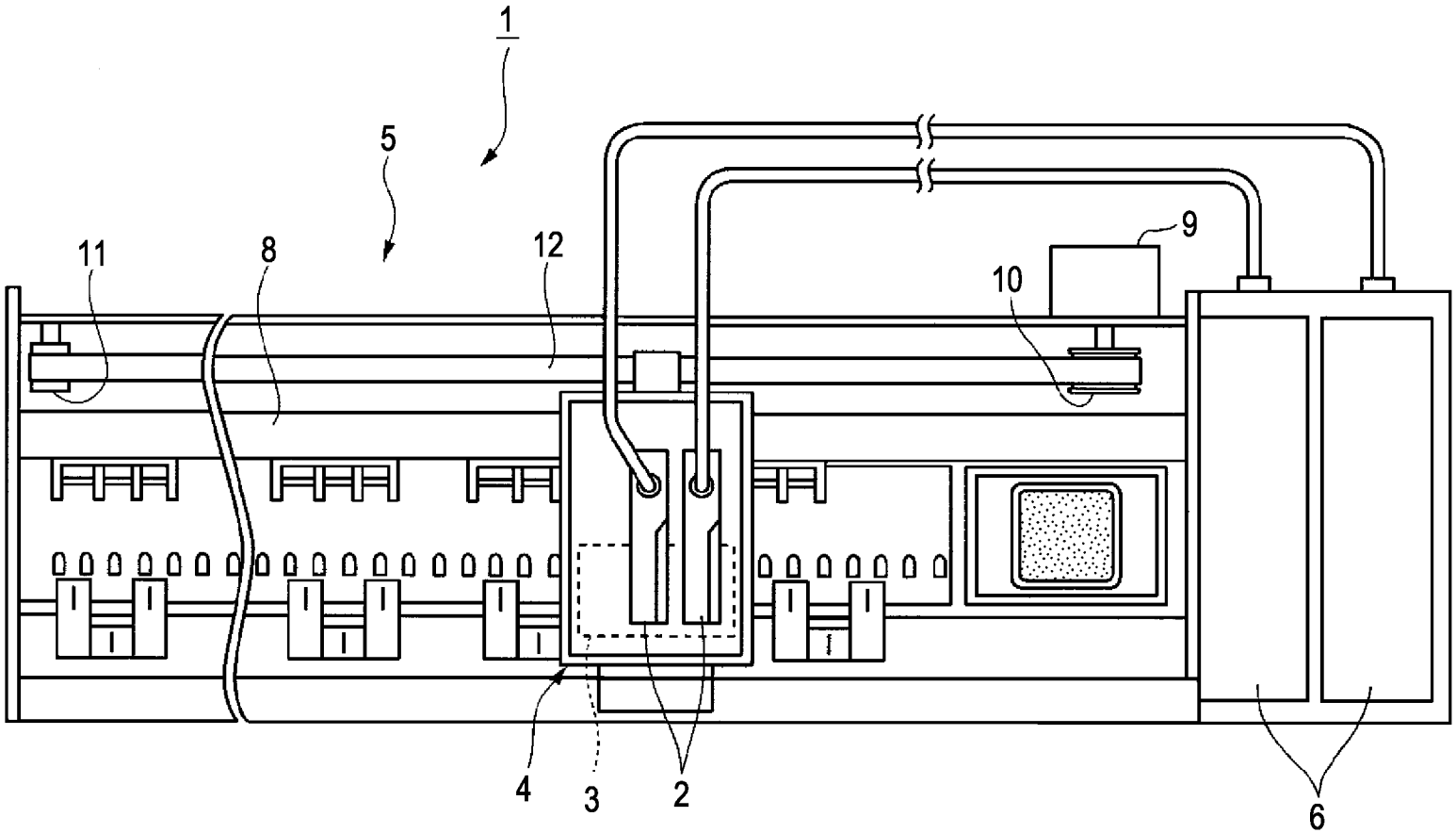
FIG. 1 is a fragmentary exploded perspective view illustrating a printer apparatus according to an embodiment of the invention.

Hereinafter, an embodiment of the invention is described with reference to drawings. FIG. 1 is a fragmentary exploded view illustrating a schematic configuration of a printer (liquid ejecting apparatus) according to an embodiment of the invention. In FIG. 1, a reference numeral 1 denotes the printer.

The printer 1 is schematically configured to include a carriage 4 on which a sub tank (first tank) 2 and a recording head (liquid ejecting head) 3 are mounted, a printer main body 5, and a main tank (second tank) 6 formed by an ink cartridge.

The printer main body 5 is provided with a carriage movement mechanism (not shown), a paper feeding mechanism (not shown) and the main tank 6 (ink cartridge). The carriage movement mechanism reciprocates the carriage 4. The paper feeding mechanism transports a recording paper (not shown). The main tank 6 stores (accommodates) ink to be supplied to the recording head 3.

The carriage movement mechanism includes a guiding shaft 8, a pulse motor 9, a driving pulley 10, a slave pulley 11, and a timing belt 12. The guiding shaft 8 is installed in the width direction of the printer main body 5. The driving pulley 10 is connected to a rotational shaft of the pulse motor 9 and is rotationally driven by the pulse motor 9. The slave pulley 11 is provided at an opposite side of the driving pulley 10 in the width direction of the printer main body 5. The timing belt 12 is stretched upon between the driving pulley 10 and the slave pulley 11 and is connected to the carriage 4. Under the configuration, the carriage 4 reciprocates in the main scanning direction along the guiding shaft 8 by driving the pulse motor 9. Further, the paper feeding mechanism includes a paper feeding motor, a paper feeding roller which is rotationally driven by the paper feeding motor, and the like. Both of the paper feeding motor and the paper feeding roller are not shown in the drawing. The paper feeding mechanism sequentially feeds the recording paper onto a platen in conjunction with a recording (printing) operation.

Figure 2:
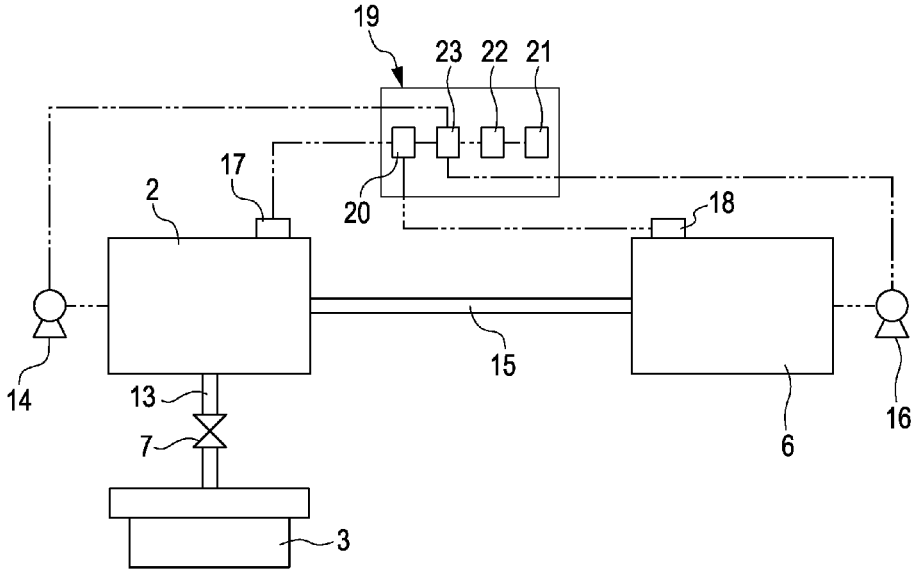
FIG. 2 is a schematic diagram illustrating a configuration of a main part for explaining the embodiment of the invention.

FIG. 2 is a plan view schematically illustrating a configuration of a main part in the periphery of the recording head 3 for explaining the embodiment of the invention.

As shown in FIG. 2, the sub tank 2 is connected to the recording head 3 through a connection tube (second flow path) 13 formed with a conducting needle, a piping or the like. With the connection tube 13, an inner portion of the sub tank 2 is communicated with an inner portion of the recording head 3. It is to be noted that an ON/OFF valve 7 is provided on the connection tube 13 in the embodiment. With the ON/OFF valve 7, the inner portion of the sub tank 2 and the inner portion of the recording head 3 can be switched between a communicated state and a shut-off state.

A pressure pump 14 is connected to the sub tank 2 and ink (liquid) accommodated in the sub tank 2 can be fed (transported) to the main tank 6 with the pressure pump 14 in a pressurized manner as will be described later. It is to be noted that the pressure pump 14 does not operate when ink is supplied from the sub tank 2 to the recording head 3. Accordingly, ink is supplied from the sub tank 2 to the recording head 3 with a mechanism which is the same as that in the existing printer.

The main tank 6 is connected to the sub tank 2 through a connection tube (first flow path) 15. With the connection tube 15, the inner portion of the sub tank 2 is communicated with an inner portion of the main tank 6. Further, a pressure pump 16 is connected to the main tank 6 and ink (liquid) accommodated in the main tank 6 can be fed (transported) to the sub tank 2 with the pressure pump 16 in a pressurized manner. In the embodiment, a liquid transfer unit according to the invention is formed by the pressure pump 16 and the pressure pump 14. The liquid transfer unit mutually transfers ink between the sub tank 2 and the main tank 6 through the connection tube (first flow path) 15.

An ink residual amount detection device is provided on each of the sub tank 2 and the main tank 6. Each ink residual amount detection device detects an amount of ink (liquid) remaining in each of the sub tank 2 and the main tank 6. That is to say, a first ink residual amount detection device (first liquid residual amount detector) 17 is provided on the sub tank 2. On the other hand, a second ink residual amount detection device (second liquid residual amount detector) 18 is provided on the main tank 6. As each of these detection devices 17, 18, a device having the following configuration is used. The device has a light-emitting portion and a light-receiving portion. Further, the device is configured such that a level of a liquid surface, that is, a liquid amount is detected by using reflection of light output from the light emitting portion by a liquid surface of ink in each tank and detecting the reflection light by the light receiving portion. Alternatively, a device having a configuration in which a float level gauge is used or a known liquid scale can be employed.

Figure 3:
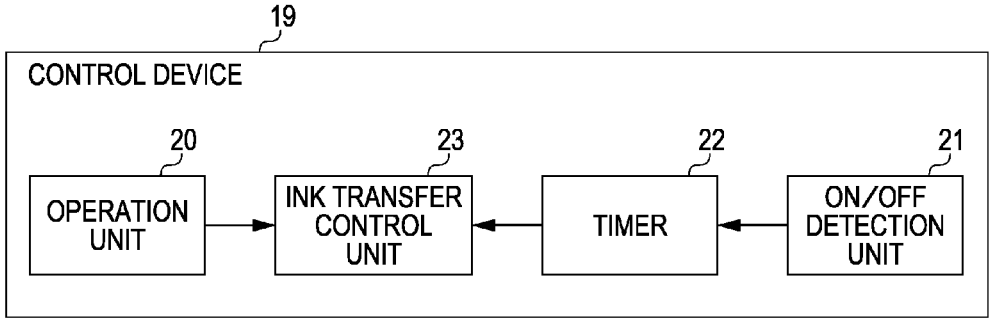
FIG. 3 is a block diagram illustrating a control device.

These detection devices 17, 18 are electrically connected to a control device (controller) 19. ON/OFF of the operations of the detection devices 17, 18 are controlled by the control device 19. Further, values detected by the detection devices 17, 18 are transmitted to the control device 19 as electric signals. As shown in FIG. 3, after the electric signals are calculated into liquid amounts by an operation unit 20, the liquid amount in the sub tank 2 and the liquid amount in the main tank 6 are compared with each other.

Further, an ON/OFF detection unit 21 is provided on the control device 19. The ON/OFF detection unit 21 detects that the printer 1 is powered ON/OFF. Further, a timer 22 is provided on the control device 19 so as to be connected to the ON/OFF detection unit 21. The timer 22 corresponds to a power shut-off time detector which detects an interval until the printer is powered ON since the printer has been powered OFF, that is, a power shut-off interval. The powered-ON time and the powered-OFF time are detected by the ON/OFF detection unit 21. Then, the detected power shut-off interval is output to an ink transfer control unit (liquid transfer controller) 23.

The ink transfer control unit 23 controls the liquid transfer unit formed by the pressure pump 14 and the pressure pump 16 and the ON/OFF valve 7 as will be described later. At this time, the ink transfer control unit 23 controls them based on the comparison result between the liquid amount in the sub tank 2 and the liquid amount in the main tank 6, the powered-ON signal and the powered-OFF signal, and the power shut-off interval. The comparison result between the liquid amount in the sub tank 2 and the liquid amount in the main tank 6 is transmitted from the operation unit 20. The powered-ON signal and the powered-OFF signal are detected by the ON/OFF detection unit 21. Further, the power shut-off interval is detected by the timer 22.

Figure 4:
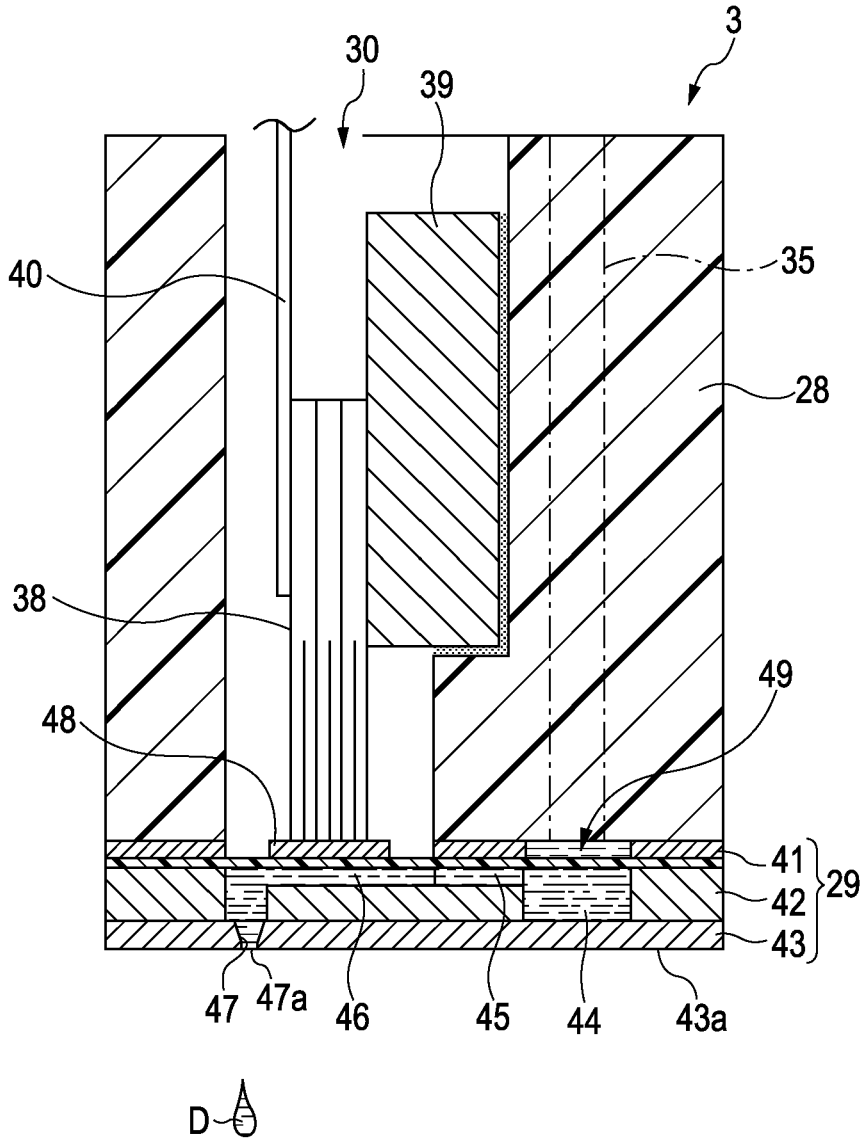
FIG. 4 is a cross-sectional side view illustrating a main part for explaining a configuration of a recording head.

The recording head 3 has a head case 28 made of a synthetic resin as shown in FIG. 4. A flow path unit 29 is bonded to a lower end surface of the head case 28. An actuator unit 30 is accommodated in the head case 28. The connection tube 13 is provided on an upper end surface at an opposite side of the flow path unit 29.

A case flow path 35 is provided in the head case 28 so as to penetrate through the head case 28 in the height direction thereof. An upper end of the case flow path 35 is communicated with the connection tube 13.

Further, a lower end of the case flow path 35 is communicated with a common ink chamber 44 in the flow path unit 29. Accordingly, ink introduced from the connection tube 13 is supplied to the common ink chamber 44 through the case flow path 35.

The actuator unit 30 accommodated in the head case 28 includes a plurality of piezoelectric vibrators (driving units) 38, a fixing plate 39, and a flexible cable 40. The plurality of piezoelectric vibrators (driving units) 38 are arranged in a row in a comb-tooth form. The piezoelectric vibrators 38 are bonded to the fixing plate 39. The flexible cable 40 serves as an interconnection member for supplying a driving signal from the side of the printer main body to the piezoelectric vibrators 38. A fixing end side of each piezoelectric vibrator 38 is bonded on the fixing plate 39. On the other hand, a free end side of each piezoelectric vibrator 38 protrudes to an outer side with respect to an edge surface of the fixing plate 39. That is, each of the piezoelectric vibrators 38 is attached to the fixing plate 39 in a so-called cantilever form.

The flow path unit 29 is a member formed as follows. That is, flow path unit constituent members including a vibration plate (sealing plate) 41, a flow path substrate 42 and a nozzle substrate 43 are integrally formed in a state where the flow path unit constituent members are laminated on one another. The flow path unit 29 forms a series of ink flow path (liquid flow path) from the common ink chamber 44 to nozzles 47 through ink supply ports 45 and pressure chambers 46. Each pressure chamber 46 is formed into an elongated chamber in the direction perpendicular to an arrangement direction of the nozzles 47 (nozzle row direction). Each pressure chamber 46 includes the corresponding piezoelectric vibrator 38. Further, the common ink chamber 44 is a chamber which is communicated with the connection tube 13 and to which ink is introduced from the sub tank 2.

Then, the ink introduced to the common ink chamber 44 is supplied so as to be distributed to each pressure chamber 46 through each ink supply port 45.

The nozzle substrate 43 arranged on the bottom of the flow path unit 29 is a thin plate made of a metal. A plurality of nozzles 47 are opened and arranged in a row on the nozzle substrate 43 at a pitch (for example, 180 dpi) corresponding to a dot formation density. A plurality of nozzle openings 47*a* are formed on a surface of the nozzle substrate 43. A nozzle opening surface 43*a* is formed with a surface of the nozzle substrate 43 on which the nozzle openings 47*a* are formed.

The flow path substrate 42 is formed by subjecting a silicon wafer as a base material having a crystal structure to anisotropic etching processing. The vibration plate 41 is a composite plate material having a double-layered structure. To be more specific, the vibration plate 41 is obtained by laminating an elastic film on a support plate made of a metal such as a stainless steel. The support plate is circularly removed by etching or the like from a portion of the vibration plate 41, which corresponds to the pressure chambers 46. Therefore, an island portion 48 to which edge surfaces of the piezoelectric vibrators 38 are bonded is formed. The portion from which the support plate is removed serves as a diaphragm portion. That is to say, the vibration plate 41 is configured such that the elastic film around the island portion 48 is elastically deformed in accordance with the operations of the piezoelectric vibrators 38. Further, the vibration plate 41 seals an opening surface at one side of the flow path substrate 42 and also serves as a compliance portion 49. The support plate is removed by etching or the like from a portion corresponding to the compliance portion 49 in the same manner as the diaphragm portion. Therefore, only the elastic film is formed on the compliance portion 49.

Then, in the recording head 3, if a driving signal is supplied to the piezoelectric vibrators 38 through the flexible cable 40, the piezoelectric vibrators 38 expand or contract in the element longitudinal direction. Accompanied with the expansion or the contraction, the island portion 48 is moved in the direction approaching to or separating from the pressure chambers 46. Therefore, volumes of the pressure chambers 46 are changed so as to cause pressure fluctuation in ink L in the pressure chambers 46. With the pressure fluctuation, ink droplets D are discharged through the nozzles 47.

Next, operations of the printer 1 having such configuration are described.

When the printer 1 is normally operated, that is, when the printer is operated in the powered-ON state, the ON/OFF valve 7 of the connection tube 13 as shown in FIG. 2 is opened. Therefore, ink is supplied from the sub tank 2 to the recording head 3, and then, ink is discharged from the recording head 3. Further, if the amount of ink in the sub tank 2 is reduced, accompanied with the discharging of the ink, ink is supplied to the sub tank 2 from the main tank 6. To be more specific, ink is supplied as follows, for example. The residual amount of ink in the sub tank 2 is detected by the first ink residual amount detection device 17. If the detected residual amount becomes equal to or less than a predetermined amount, the control device 19 controls to operate the pressure pump 16 so as to transfer ink to the sub tank 2 from the main tank 6.

After the printer is operated in such a manner, if the printer is powered OFF in order to end the operation, the ON/OFF detection unit 21 of the control device 19 detects the powered-OFF timing and the timer 22 counts a power shut-off interval.

Then, if the printer is powered ON in order to operate the printer again, the ON/OFF detection unit 21 detects the powered-ON timing and the timer 22 detects the power shut-off interval.

In the embodiment, the control device 19 makes a method of controlling the liquid transfer unit different based on the power shut-off interval detected by the timer 22. That is, if the power shut-off interval is long and ink does not flow in the tanks 2, 6 for a long period of time, settling and separation of solid content and non-uniformity of solid content concentration in the ink are accelerated. In contrast, if the power shut-off interval is relatively short, the settling and separation of solid content and the non-uniformity of the solid content concentration in the ink is relatively moderate. Then, the degree of settling and separation is judged based on the power shut-off interval, and the control device 19 makes a method of controlling the liquid transfer unit different between a case where the degree of the settling and separation is large and a case where the degree of the settling and separation is small.

At first, as the case where the degree of the settling and separation is small, a control method when the power shut-off interval is less than 48 hours is described. Note that a power shut-off interval as a reference is appropriately set depending on types of ink, capacities of the tanks and the like, and "48 hours" is merely an example thereof. Accordingly, the power shut-off interval as a reference is previously set at the time of manufacturing or can be arbitrarily set by a user.

If the ON/OFF detection unit 21 detects that the powered-OFF state is switched to the powered-ON state and the timer 22 detects that the power shut-off interval is less than 48 hours, the control device 19 controls to close the ON/OFF valve 7 of the connection tube 13. Then, the control device 19 controls the first ink residual amount detection device 17 and the second ink residual amount detection device 18 so as to detect residual amounts of inks in the sub tank 2 and the main tank 6.

When the residual amounts of inks in the sub tank 2 and the main tank 6 are detected, the detection results are transmitted to the operation unit 20 of the control device 19. Then, the residual amounts of inks in the sub tank 2 and the main tank 6 are compared with each other so that a tank of which residual amount of ink is larger than that of the other tank is recognized by the control device 19.

Then, the ink transfer control unit 23 of the control device 19 controls to operate the liquid transfer unit, that is, the pressure pump 14 or the pressure pump 16, such that ink is transferred to the tank of which residual amount of ink is smaller from the tank of which residual amount of ink is larger. At this time, basically, all the residual amount of ink in the tank of which residual amount of ink is larger is not transferred to the tank of which residual amount of ink is smaller. Alternatively, a predetermined amount of residual ink, for example, an appropriate amount of substantially half to 95% of residual amount is transferred.

The tank of which residual amount of ink is smaller receives ink supply by transferring ink to the tank of which residual amount of ink is smaller from the tank of which residual amount of ink is larger in such a manner. Therefore, a stirring effect can be obtained in the tank of which residual amount of ink is smaller. That is to say, ink which has remained in the tank as well as ink supplied from the tank of which residual amount of ink is larger also flow in the tank. Therefore, even if the solid content in the ink has been settled down while the power has been in the OFF state, the solid content is stirred and mixed. Accordingly, since the solid content is uniformly dispersed again, the solid content concentration is made uniform in the ink.

Therefore, if the tank of which residual amount of ink is smaller is assumed to be the sub tank 2, the control device 19 controls to open the ON/OFF valve 7 of the connection tube 13 again so that operations at the normal time are made to be performed. Therefore, ink is supplied to the recording head 3 from the sub tank 2, and then, ink is discharged from the recording head 3.

On the other hand, if the tank of which residual amount of ink is smaller is assumed to be the main tank 6, the control device 19 controls to operate the pressure pump 16 (liquid transfer unit) so as to transfer (return) ink in the main tank 6 to the sub tank 2. Therefore, the solid content concentration in the ink transferred to the sub tank 2 is made uniform further. Thereafter, the control device 19 controls to open the ON/OFF valve 7 of the connection tube 13 again so that ink is supplied from the sub tank 2 to the recording head 3, and then, ink is discharged from the recording head 3 as described above.

Accordingly, after the solid content concentration in the ink is made uniform in the tank as described above, the ink is supplied to the recording head 3 and discharged from the recording head 3. Therefore, disadvantages caused by settling of the solid content in the ink can be eliminated and discharge characteristics are made stable. Further, recording quality can be made uniform and improved.

Next, as a case in which the settling and separation is large, a case where the power shut-off interval is equal to or more than 48 hours is described, for example.

If the ON/OFF detection unit 21 detects that the powered-OFF state is switched to the powered-ON state and the timer 22 detects that the power shut-off interval is equal to or more than 48 hours, the control device 19 controls to close the ON/OFF valve 7 of the connection tube 13 as in the above example. Then, the control device 19 controls the first ink residual amount detection device 17 and the second ink residual amount detection device 18 so as to detect residual amounts of inks in the sub tank 2 and the main tank 6.

When the residual amounts of inks in the sub tank 2 and the main tank 6 are detected, the detection results are transmitted to the operation unit 20 of the control device 19. Then, residual amounts of inks in the sub tank 2 and the main tank 6 are compared with each other so that a tank of which residual amount of ink is larger than that of the other tank is recognized by the control device 19.

Then, the ink transfer control unit 23 of the control device 19 controls to operate the liquid transfer unit, that is, the pressure pump 14 or the pressure pump 16 such that ink is transferred to the tank of which residual amount of ink is smaller from the tank of which residual amount of ink is larger as in the above example. At this time, basically, all the residual amount of ink in the tank of which residual amount of ink is larger is not transferred to the tank of which residual amount of ink is smaller. Alternatively, a predetermined amount of residual ink, for example, an appropriate amount of substantially half to 95% of residual amount is transferred.

In this case, since the power shut-off interval is equal to or more than 48 hours (predetermined time), settling of the solid content is accelerated in the tank of which residual amount of liquid is larger so that the solid content concentration is made different largely between an upper portion and a lower portion in the tank in some case. If only liquid in the upper portion (supernatant liquid) is transferred to the tank of which residual amount of ink is smaller under the state, the solid content concentration in the liquid is decreased in the tank.

In the embodiment, the following operations are performed in order to cope with the problem. That is, after a predetermined amount (appropriate amount) of ink is transferred to the tank of which residual amount of ink is smaller from the tank of which residual amount of ink is larger, the control device 19 controls to operate the liquid transfer unit such that an ink transferring direction between the tanks is made reverse. That is to say, the pressure pump which has been operated is stopped first and the pressure pump which has been stopped is operated. With the operations, settling can be eliminated in both of the tanks 2, 6 while the solid content concentration in ink in each of the tanks is made uniform.

Accordingly, after the solid content concentration in ink is made uniform in the tanks as described above, the ink is supplied to the recording head 3 and discharged from the recording head 3. Therefore, disadvantages caused by settling of the solid content in the ink can be eliminated and discharge characteristics are made stable. Further, recording quality can be made uniform and improved.

It is to be noted that although a case where a control method is made different based on the power shut-off interval has been described in the above embodiment, for example, the control method can be made different based on a ratio of the residual amounts of inks between the sub tank 2 and the main tank 6.

To be more specific, the operation unit 20 detects whether the ratio of the residual amounts of inks between the tanks is less than a predetermined ratio or equal to or more than the predetermined ratio. Then, if the ratio is equal to or more than the predetermined ratio, for example, equal to or more than twice, the following operation is performed. That is, when ink is transferred to the tank of which residual amount of ink is smaller from the tank of which residual amount of ink is larger, all the residual amount of ink is not transferred to the tank at the time of a first transferring. Alternatively, a small amount of the residual ink, for example, equal to or less than half of the residual amount is transferred at the time of the first transferring. That is to say, when the residual amount of ink in the tank of which residual amount of ink is larger is 90 in a capacity ratio and that in the tank of which residual amount of ink is smaller is 10 in the capacity ratio, 10 parts of ink are transferred to the tank with a smaller residual amount from 90 parts of ink in the tank with a larger residual amount of ink.

Subsequently, ink is returned from the tank of which residual amount of ink is smaller to the tank of which residual amount of ink is larger. At this time, for example, all the residual amount of ink is transferred. That is, after 10 parts of ink are transferred from 90 parts of ink and the capacity ratio between the tanks becomes 80:20, all of 20 parts of ink are returned. Therefore, the capacity ratio becomes 100:0 between the tanks.

After that, all the amount (or appropriate amount) of ink is repeatedly transferred a desired number of times if necessary. Finally, a desired amount of ink is set to remain in the sub tank. Then, the ON/OFF valve 7 is opened in this state and ink is supplied from the sub tank 2 to the recording head 3.

With this configuration, the solid content which has settled down in the tank can be also uniformly dispersed again. Therefore, the solid content concentration is made uniform in the ink. Further, discharge characteristics are made stable and recording quality can be improved.

Figure 5:
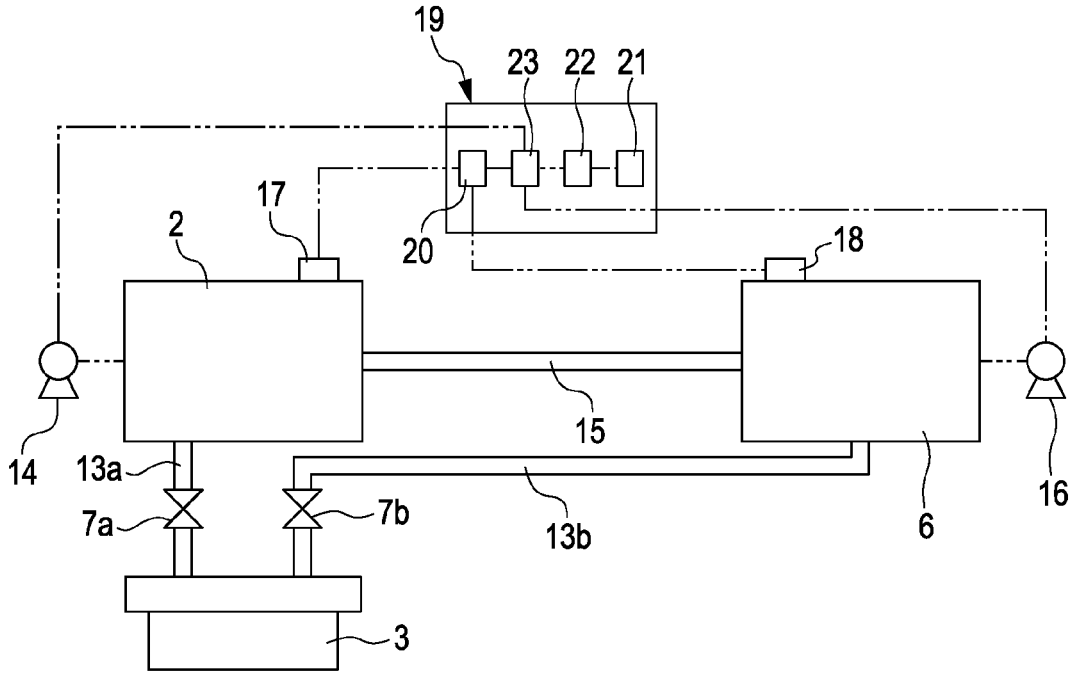
FIG. 5 is a schematic diagram illustrating a configuration of a main part for explaining another embodiment of the invention.

FIG. 5 is a plan view schematically illustrating a configuration of a main part in the periphery of the recording head 3 for explaining another embodiment of the invention.

In the embodiment, the following point is different from the above embodiment as shown in FIG. 2. That is, in the above embodiment as shown in FIG. 2, only the sub tank (first tank) 2 is directly communicated with the recording head (liquid ejecting head) 3 through the connection tube (second flow path) 13. However, in the embodiment as shown in FIG. 5, both of the sub tank 2 and the main tank 6 are directly communicated with the recording head (liquid ejecting head) 3 through a first connection tube 13*a* and a second connection tube 13*b*, respectively.

Accordingly, in the embodiment, a first tank 2 and a second tank 6 are not distinguished from each other by the expressions "sub tank" and "main tank." Hereinafter, the tanks are referred to as the first tank 2 and the second tank 6. It is to be noted that either of the tanks may be formed with an ink cartridge as in the above embodiment.

In the embodiment, a first ON/OFF valve 7*a* is provided on the first connection tube 13*a* and a second ON/OFF valve 7*b* is provided on the second connection tube 13*b*. A second flow path according to the invention is formed by the first connection tube 13*a* and the second connection tube 13*b*. Further, a switching valve according to the invention is formed by the first ON/OFF valve 7*a* and the second ON/OFF valve 7*b*.

Operations of a printer having such configuration are described.

In such printer, if the power is switched from the ON state to the OFF state, the ON/OFF detection unit 21 of the control device 19 detects the powered-OFF timing and the timer 22 of the control device 19 counts the power shut-off interval as in the printer having the configuration as shown in FIG. 2.

Then, if the power is turned ON in order to operate the printer again, the ON/OFF detection unit 21 detects the powered-ON timing and the timer 22 detects the power shut-off interval.

It is to be noted that the control device 19 makes a method of controlling the liquid transfer unit different based on the power shut-off interval detected by the timer 22 as in the above embodiment. That is, the method of controlling the liquid transfer unit is made different between a case where the degree of the settling and separation is small and a case where the degree of the settling and separation is large.

As the case where the degree of the settling and separation is small, a control method when the power shut-off interval is less than 48 hours is described at first.

If the ON/OFF detection unit 21 detects that the powered-OFF state is switched to the powered-ON state and the timer 22 detects that the power shut-off interval is less than 48 hours, the control device 19 controls to close the first ON/OFF valve 7*a* of the first connection tube 13*a* and the second ON/OFF valve 7*b* of the second connection tube 13*b*. Then, the control device 19 controls the first ink residual amount detection device 17 and the second ink residual amount detection device 18 so as to detect residual amounts of inks in the first tank 2 and the second tank 6.

When the residual amounts of inks in the first tank 2 and the second tank 6 are detected, the residual amounts of inks in the first tank 2 and the second tank 6 are compared with each other in the same manner as in the above embodiment. Therefore, a tank of which residual amount of ink is larger than that of the other tank is recognized by the control device 19.

Then, the ink transfer control unit 23 of the control device 19 controls to operate the liquid transfer unit (the pressure pump 14 or the pressure pump 16) such that ink is transferred to the tank of which residual amount of ink is smaller from the tank of which residual amount of ink is larger. At this time, basically, all the residual amount of ink in the tank of which residual amount of ink is larger is not transferred to the tank of which residual amount of ink is smaller. Alternatively, a predetermined amount of residual ink, for example, an appropriate amount of substantially half to 95% of residual amount is transferred as described in the above embodiment.

The tank of which residual amount of ink is smaller receives ink supply by transferring ink to the tank of which residual amount of ink is smaller from the tank of which residual amount of ink is larger in such a manner. Therefore, a stirring effect can be obtained in the tank of which residual amount of ink is smaller as in the above embodiment. Accordingly, since the solid content is uniformly dispersed again, the solid content concentration is made uniform in the ink.

Therefore, if ink is transferred in such a manner, the control device 19 controls to open the ON/OFF valve of the connection tube (second flow path) corresponding to the tank to which ink has been transferred, that is, the tank in which residual amount of ink has been smaller. Then, operations at the normal time are made to be performed. Therefore, ink is supplied to the recording head 3 from the first tank 2, and then, ink is discharged from the recording head 3.

Accordingly, in the aforementioned embodiment, if the tank of which residual amount of ink is smaller is assumed to be the main tank 6, ink in the main tank 6 is required to be transferred to the sub tank 2 again finally. In contrast, in the embodiment, the operation is not required to be performed so that printing by discharging ink can be performed more rapidly.

Further, as the case where the degree of the settling and separation is large, when the power shut-off interval is equal to or more than 48 hours, the second ink transfer is performed subsequently to the first ink transfer performed when the power shut-off interval is less than 48 hours (ink transfer to the tank of which residual amount of ink is smaller from the tank of which residual amount of ink is larger) in the same manner as in the aforementioned embodiment. In the second transfer, an ink transferring direction between the tanks is made reverse.

With this configuration, settling can be eliminated in both of the tanks 2, 6 and the solid content concentration in ink in each of the tanks is made uniform.

Accordingly, after ink is transferred in such a manner, the control device 19 controls to open the ON/OFF valve of the connection tube (second flow path) corresponding to the tank to which ink has been transferred lastly. Then, operations at the normal time are made to be performed. Therefore, ink is supplied to the recording head 3 from the first tank 2, and then, ink is discharged from the recording head 3.

In the printer having such configuration, the following effect can be also obtained. That is, after the solid content concentration in ink in the tank is made uniform, the ink is discharged from the recording head 3. Accordingly, disadvantages caused by settling of the solid content in the ink can be eliminated. Further, discharge characteristics can be made stable and recording quality can be made uniform and improved.

In addition, in the printer, the tank in which settling has been eliminated is selected by the first ON/OFF valve 7*a* and the second ON/OFF valve 7*b* and liquid is supplied to the liquid ejecting head. Therefore, disadvantages caused by settling can be eliminated more reliably.

It is to be noted that the invention is not limited to the above embodiments and various modifications can be made within a range without departing from the spirit of the invention.

For example, in the above embodiment, the number of times of the ink transferring between the tanks is not limited to once or twice; the ink transferring may be performed equal to or more than three times. In this case, an amount of ink transferred can be appropriately set.

Further, in the embodiment as shown in FIG. 5, particularly in a case where ink is transferred equal to or more than three times or the like, the control device 19 may select a tank of which residual amount of ink is larger as a tank which is finally communicated with the recording head 3 and control to open an ON/OFF valve corresponding to the selected tank. With this configuration, liquid can be preferentially supplied to the liquid ejecting head from the tank of which residual amount of liquid is larger. Accordingly, liquid droplets can be discharged stably for a long period of time.

Further, in the embodiment as shown in FIG. 5, a control method may be made different based on a ratio of residual amounts of inks between the first tank 2 and the second tank 6 as in the embodiment shown in FIG. 2.

Moreover, in the embodiment as shown in FIG. 5, the second flow path is formed by the first connection tube 13*a* and the second connection tube 13*b* and the switching valve is formed by the first ON/OFF valve 7*a* and the second ON/OFF valve 7*b*. However, the second flow path may be formed by making the first connection tube 13*a* and the second connection tube 13*b* merge at the middle way. Further, the merged second flow path may be communicated with the recording head. In this case, a three-way valve may be provided at a junction point so as to be set as the switching valve.

Further, in the above embodiments, a case where the liquid ejecting apparatus according to the invention is applied to a consumer printer has been described. However, the invention is not limited thereto and the liquid ejecting apparatus can be also applied to a liquid ejecting apparatus for industrial use, which is used for manufacturing a color filter in a liquid crystal display apparatus and an organic EL apparatus.

The entire disclosure of Japanese Patent Application No. 2009-269936, filed Nov. 27, 2009 is expressly incorporated by reference herein.

What is claimed is:

1. A liquid ejecting apparatus, comprising:
a liquid ejecting head which ejects liquid;
a first tank which accommodates the liquid;
a second tank which accommodates the liquid;
a first liquid residual amount detector which detects a residual amount of liquid in the first tank;
a second liquid residual amount detector which detects a residual amount of liquid in the second tank;
a first flow path which makes the first tank and the second tank communicate with each other;
a second flow path which makes at least one of the first tank and the second tank communicate with the liquid ejecting head;
a liquid transfer unit which is capable of transferring liquid in the first tank into the second tank through the first flow path and transferring liquid in the second tank into the first tank through the first flow path;
an ON/OFF detector which detects that power of the liquid ejecting apparatus is turned ON/OFF; and
a controller which controls the liquid transfer unit, and
when the ON/OFF detector detects that the power of the liquid ejecting apparatus is switched to an ON state from an OFF state, the controller controls the liquid transfer unit such that liquid is transferred to a tank of which residual amount of liquid is smaller from a tank of which residual amount of liquid is larger based on the residual amount of liquid in the first tank detected by the first liquid residual amount detector and the residual amount of liquid in the second tank detected by the second liquid residual amount detector;
wherein a power shut-off time detector which detects a power shut-off interval until the liquid ejecting apparatus is powered ON since the liquid ejecting apparatus has been powered OFF is provided, and
when the ON/OFF detector detects that the power of the liquid ejecting apparatus is switched to the ON state from the OFF state and the power shut-off time detector detects that the power shut-off interval is equal to or more than a predetermined interval, the controller controls the liquid transfer unit such that after liquid is transferred to a tank of which residual amount of liquid is smaller from a tank of which residual amount of liquid is larger, a liquid transferring direction between the tanks is made reverse and liquid is transferred again.

2. The liquid ejecting apparatus according to claim 1, wherein when liquid is transferred to a tank of which residual amount of liquid is smaller from a tank of which residual amount of liquid is larger by the liquid transfer unit, the controller controls the liquid transfer unit such that all the amount of liquid in the tank of which residual amount of liquid is larger is not transferred and only a predetermined amount of liquid is transferred, and then, a liquid transferring direction between the tanks is made reverse and liquid is transferred again.

3. The liquid ejecting apparatus according to claim 1, wherein the second flow path is configured such that both of the first tank and the second tank are communicated with the liquid ejecting head and that a switching valve which makes any one of the first tank and the second tank communicate with the liquid ejecting head and shuts out the other of the first tank and the second tank is provided on the second flow path.

4. The liquid ejecting apparatus according to claim 3, wherein after the liquid transferring between the tanks by the liquid transfer unit is ended, the controller controls the switching valve such that a tank of which residual amount of liquid is larger is communicated with the liquid ejecting head.

5. A liquid ejecting apparatus, comprising:
a liquid ejecting head which ejects liquid;
a first tank which accommodates the liquid;
a second tank which accommodates the liquid;
a first flow path which makes the first tank and the second tank communicate with each other;
a second flow path which makes at least one of the first tank and the second tank communicate with the liquid ejecting head;
a liquid transfer unit which is capable of transferring liquid in the first tank into the second tank through the first flow path and transferring liquid in the second tank into the first tank through the first flow path; and
a controller which controls the liquid transfer unit, such that when the power of the liquid ejecting apparatus is switched to an on state from an off state, the controller controls the liquid transfer unit such that liquid is transferred to a tank of which residual amount of liquid is smaller from a tank of which residual amount of liquid is larger based on the residual amount of liquid in the first tank and the residual amount of liquid in the second tank; wherein when liquid is transferred to a tank of which residual amount of liquid is smaller from a tank of which residual amount of liquid is larger by the liquid transfer unit, the controller controls the liquid transfer unit such that all the amount of liquid in the tank of which residual amount of liquid is larger is not transferred and only a predetermined amount of liquid is transferred, and then, a liquid transferring direction between the tanks is reversed and liquid is transferred again.

6. The liquid ejecting apparatus according to claim 5, further comprising a third flow path which makes another one of the first tank and the second tank communicate with the liquid ejecting head.

7. The liquid ejecting apparatus according to claim 5, wherein the first tank is a sub-tank, and the second tank is a main tank.

8. A liquid ejecting apparatus, comprising:
a liquid ejecting head which ejects liquid;
a first tank which accommodates the liquid;
a second tank which accommodates the liquid;
a first liquid residual amount detector which detects a first residual amount of liquid in the first tank;
a second liquid residual amount detector which detects a second residual amount of liquid in the second tank;
a first flow path which provides fluid communication between the first tank and the second tank;
a second flow path which provides fluid communication between the first tank and the liquid ejecting head;
a liquid transfer unit which is configured to transfer liquid from the first tank to the second tank through the first flow path and to transfer liquid from the second tank to the first tank through the first flow path; and
a controller which controls the liquid transfer unit, such that when the power of the liquid ejecting apparatus is switched to an on state from an off state, the controller:
determines whether the first residual amount of liquid is larger or smaller than the second residual amount of liquid;
when the first residual amount of liquid is larger than the second residual amount of liquid, controls the liquid transfer unit such that liquid is transferred from the first tank to the second tank; and
when the first residual amount of liquid is smaller than the second residual amount of liquid, controls the liquid transfer unit such that liquid is transferred from the second tank to the first tank; when the power of the liquid ejecting apparatus is switched to the on state from the off state, the controller further determines how long the power of the liquid ejecting apparatus has been in the off state and controls the liquid transfer unit differently depending on how long the power of the liquid ejecting apparatus has been in the off state.

9. The apparatus of claim 8, wherein during normal operation, when the first residual amount of liquid is less than a predetermined amount, the controller controls the liquid transfer unit such that liquid is transferred from the second tank to the first tank.

10. The apparatus of claim 8, wherein when the power of the liquid ejecting apparatus has been in the off state for greater than a predetermined amount of time:

when the first residual amount of liquid is larger than the second residual amount of liquid, the controller controls the liquid transfer unit such that liquid is transferred from the first tank to the second tank, and subsequently controls the liquid transfer unit such that the liquid is transferred from the second tank to the first tank; and when the first residual amount of liquid is smaller than the second residual amount of liquid, the controller controls the liquid transfer unit such that liquid is transferred from the second tank to the first tank, and subsequently controls the liquid transfer unit such that the liquid is transferred from the first tank to the second tank.

11. The apparatus of claim 8, wherein the controller controls the liquid transfer unit differently depending on a ratio of the first residual amount of liquid to the second residual amount of liquid.

12. The apparatus of claim 11, wherein:

when the first residual amount of liquid is larger than the second residual amount of liquid and the ratio is greater than a first set ratio, the controller controls the liquid transfer unit such that liquid is transferred from the first tank to the second tank, and subsequently controls the liquid transfer unit such that the liquid is transferred from the second tank to the first tank; and when the first residual amount of liquid is smaller than the second residual amount of liquid and the ratio is less than a second set ratio, the controller controls the liquid transfer unit such that liquid is transferred from the second tank to the first tank, and subsequently controls the liquid transfer unit such that the liquid is transferred from the first tank to the second tank.

13. The apparatus of claim 12, wherein during the subsequent control, the controller controls the liquid transfer unit such that all the liquid present in the first or second tank is transferred to the other one of the first or second tank.

14. The apparatus of claim 12, wherein the second set ratio is the inverse of the first set ratio.

15. The apparatus of claim 8, further comprising a third flow path which provides fluid communication between the second tank and the liquid ejecting head.

* * * * *